United States Patent [19]

Menon et al.

[11] 4,025,181

[45] May 24, 1977

[54] SCREEN CLEANING DEVICE

[75] Inventors: Sukumaran K. Menon, Webster; Zenon Guran, Rochester, both of N.Y.

[73] Assignee: Xerox Corporation, Stamford, Conn.

[22] Filed: Jan. 7, 1976

[21] Appl. No.: 647,289

[52] U.S. Cl. ..... 355/3 R; 355/4; 355/15

[51] Int. Cl.[2] ..... G03G 15/00

[58] Field of Search ..... 355/3 R, 4, 15; 15/246, 15/256.51, 256.52

[56] References Cited

OTHER PUBLICATIONS

"A Half Tone Screen Cleaning Device", 14033, Research Disclosure, Dec. 75.

*Primary Examiner*—R. L. Moses

*Attorney, Agent, or Firm*—J. J. Ralabate; H. Fleischer; C. A. Green

[57] ABSTRACT

An electrophotographic printing machine in which particles are cleaned from a half-tone image screen. The screen is movable from an operative position closely adjacent to the printing machine photoconductive member to an inoperative location remote therefrom. As the screen moves in one direction, a cleaning device moves in a direction opposed thereto so as to remove particles therefrom.

18 Claims, 6 Drawing Figures

SCREEN CLEANING DEVICE

BACKGROUND OF THE INVENTION

This invention relates generally to an electrophotographic printing machine, and more particularly concerns an apparatus for removing contaminants from a screen member operatively associated with a photoconductive member disposed therein.

As in all electrophotographic printing machines, the original document being reproduced is illuminated to form a light image thereof. The light image irradiates the charged portion of the photoconductive member dissipating selectively the charge thereon to record an electrostatic latent image. Heat settable particles develop the latent image. These particles are transferred to a sheet of support material, in image configuration. Thereafter, heat is applied to the particles permanently affixing them to the sheet of support material.

In the process of multi-color electrophotographic printing, a plurality of electrostatic latent images are recorded on the photoconductive member, each latent image corresponds to different color information in the original document. The latent images are developed with appropriately colored toner particles. The particles are then transferred to the sheet of support material in superimposed registration with one another. Thereafter, the resultant composite powder image is permanently affixed to the sheet of support material by the application of heat thereto forming a color copy of the original document.

Pictorial quality copies are reproduced in electrophotographic printing machine by employing half-tone imaging screens. The screen produces tone gradations by forming half-tone dots or lines of varying sizes. The dots increase in size from the highlight regions throughout the intermediate shades until merging together in the shadow regions. However, when this screen has contaminants deposited thereon, copy quality is degradated. These contaminants are more frequent in color electrophotographic printing machines than in black and white printing machines. This is due to the fact that a color printing machine will generally employ a plurality of differently colored developer materials, whereas black and white printing machines only utilize only black particles. It is evident that there is a significantly greater amount of particle contamination in color machines than in the black and white machines. Thus, the screen employed in a color printing machine is frequently contaminated and requires periodic cleaning.

Various types of brush cleaning devices have been developed for cleaning screens employed in electrophotographic printing machines. Typical screen cleaning systems are described in co-pending application Ser. No. 566,872 filed in 1975, and co-pending application Ser. No. 567,149 filed in 1975. Both of the foregoing applications relate to different types of brush cleaning mechanisms for use with a screen employed in an electrophotographic printing machine. However, even with brush cleaning systems of the type hereinbefore employed, the screen may still contain particle contaminants thereon.

Accordingly, it is the primary object of the present invention to improve the cleaning of a half-tone imaging screen employed in an electrophotographic printing machine.

SUMMARY OF THE INVENTION

Briefly stated, and in accordance with the present invention, there is provided an electrophotographic printing machine having a photoconductive member.

Pursuant to the features of the present invention, the printing machine includes a screen member mounted movably therein. In the operative position, the screen member is located closely adjacent to the photoconductive member, while in the inoperative position, being remote therefrom. Means are provided for cleaning particles from the screen member. The cleaning means is mounted for movement in unison with the screening member, in a direction opposed thereto, removing particles therefrom during the relative movement therebetween.

BRIEF DESCRIPTION OF THE DRAWINGS

Other objects and advantages of the present invention will become apparent upon reading the following detailed description and upon reference to the drawings, in which.

While the present invention will be described in connection with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

Figure 1:
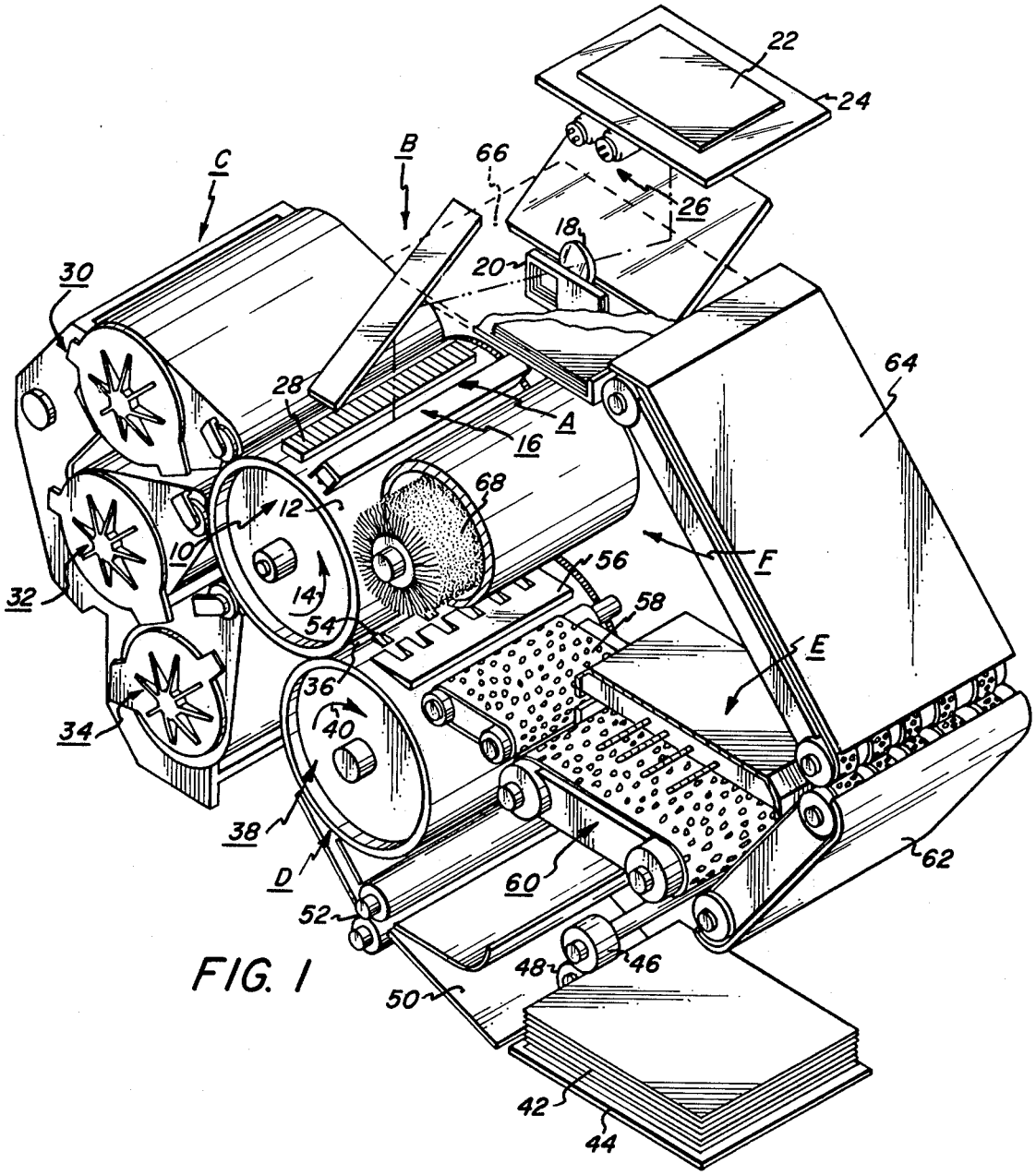
FIG. 1 is a schematic perspective view depicting an electrophotographic printing machine incorporating the features of the present invention therein.

FIG. 1 depicts an electrophotographic printing machine incorporating the features of the present invention therein. In all of the drawings, like reference numerals have been used to designate identical elements. The printing machine reproduces original documents in the form of single sheets, books or three dimensional objects. While the screen cleaning system of the present invention is particularly well adapted for use in electrophotographic printing machines, it will be evident from the following description that it may be also utilized in many other applications.

With continued reference to FIG. 1, the electrophotographic printing machine depicted therein includes a photoconductive member having a rotatable drum 10 with a photoconductive surface 12 entrained thereabout and secured thereto. Drum 10 is journaled for rotation on a suitable shaft (not shown) and rotates in the direction of arrow 14. This moves photoconductive surface 12 sequentially through a series of processing stations. Preferably, photoconductive surface 12 is made from a suitable polychromatic selenium alloy such as is described in U.S. Pat. No. 3,655,377 issued to Sechak in 1972. A timing disc (not shown) is mounted on one end of the shaft of drum 10. The timing disc rotates with drum 10 and is interposed between a light source and photosensor. In this manner, electrical pulses are generated which are processed by the machine logic. Thus, as drum 10 rotates, the appropriate processing station is actuated by the machine logic.

For purposes of the present disclosure, each of the processing stations employed in the electrophotographic printing machine of FIG. 1 will be briefly described hereinafter.

As drum 10 rotates in the direction of arrow 14, photoconductive surface 12 passes through charging station A. Charging station A includes a corona generating device, indicated generally by the reference numeral 16, for charging at least a portion of photoconductive surface 12. One type of suitable corona generating device is described in U.S. Pat. No. 3,875,407 issued to Hayne in 1975.

After photoconductive surface 12 is charged, drum 10 rotates the charged portion thereof to exposure station B. At exposure station B, a filtered light image of the original document is projected onto the charged portion of photoconductive surface 12. A moving lens system, generally designated by the reference numeral 18, and a color filter mechanism, shown generally at 20, move in a timed relationship with drum 10 to scan successive incremental areas of original document 22 disposed upon transparent platen 24. Lamps 26, disposed beneath platen 24, illuminate successive incremental areas of original document 22. U.S. Pat. No. 3,062,108 issued to Mayo in 1952 describes a suitable moving lens system. Similarly, U.S. Pat. No. 3,775,006 issued to Hartman et al., in 1973 discloses a suitable filter mechanism. A suitable type of lens is described in U.S. Pat. No. 3,592,531 issued to McCrobie in 1971. The foregoing elements cooperate with one another to produce a single color flowing light image of the original document. This single color light image is transmitted through screen member 28. In one embodiment (FIG. 2) screen member 28 is interposed into the optical light path. In an alternate embodiment (FIG. 3), screen member 28 is located remote from the optical path. Both of these embodiments will be discussed hereinafter in greater detail with reference to FIGS. 2 and 3. Screen member 28 is mounted pivotably in the printing machine so as to be positioned closely adjacent to photoconductive surface 12 or remote therefrom. As screen member 28 pivots, a cleaning device moves in unison therewith in an opposed direction to remove dirt particles therefrom. The structure for accomplishing the foregoing is shown in greater detail in FIGS. 4 through 6, inclusive. Screen member 28 modulates the single color light image irradiating the charged portion of photoconductive surface 12 to record thereon a modulated single color electrostatic latent image. However, if the printing machine is operating in the functional mode rather than the pictorial mode, the screen member may be removed from the optical path or de-activated. Thus, the electrostatic latent image recorded on the photoconductive surface will no longer be modulated.

After the latent image is recorded on photoconductive surface 12, drum 10 rotates to development C. At development station C, three individual developer units, generally indicated by the reference numerals 30, 32 and 34, respectively, render successive electrostatic latent images visible. A suitable development station employing developer units suitable for use in a color electrophotographic printing machine is described in U.S. Pat. No. 3,854,449 issued to Davidson in 1974. All of the developer units employed in the printing machine are magnetic brush developer units. A typical magnetic brush developer unit employs a magnetizable developer mix of carrier granules and toner particles. The developer unit forms a directional flux field to continually create a magnetic brush of developer mix. This brush of developer mix is brought into contact with the latent image recorded on photoconductive surface 12. The toner particles adhering electrostatically to the carrier granules are attracted by the greater electrostatic force of the latent image, thereby rendering it visible. Developer units 30, 32 and 34, respectively, contain differently colored toner particles. Each of the toner particles contained in the respective developer units correspond to the complement of the single color light image transmitted through each of the differently colored filters of filter mechanism 20. For example, a latent image formed from a green filtered light image is rendered visible by depositing green absorbing magenta toner particles thereon. Similarly, latent images formed from blue and red light images are developed with yellow and cyan toner particles, respectively.

After the latent image recorded on photoconductive surface 12 is developed, drum 10 rotates to transfer station D. At transfer station D, the toner powder image adhering electrostatically to photoconductive surface 12 is transferred to a sheet of support material 36. Support material 36 is secured releasably to a transfer roll, shown generally at 38. Transfer roll 38 is electrically biased to a potential of sufficient magnitude and polarity to electrostatically attract toner particles from photoconductive surface 12 to support material 36 secured thereon. Arrow 40 indicates the direction of rotation of transfer roll 38. Transfer roll 38 and drum 10 have the same tangential velocity. Thus, successive toner powder images may be transferred from photoconductive surface 12 to sheet 36 in superimposed registration with one another. This produces a multilayered toner powder image, each of the layers being of different color. A suitable electrically biased transfer roll is described in U.S. Pat. No. 3,612,677 issued to Langdon et al., in 1971.

Prior to proceeding with the description of the remaining processing stations, the sheet feeding path will be briefly described. Support material 36 is advanced from a stack 42 thereof disposed upon tray 44. Feed roll 46, in operative communication with retard roll 48, separates and advances the uppermost sheet from stack 42. The sheet moves into chute 50 which directs it into the nip of register rolls 52. Register rolls 52 align and forward the advancing sheet, in synchronism with the movement of transfer roll 38. Gripper fingers 54, mounted on transfer roll 38, receive sheet 36 and secure it releasably thereon. After the requisite number of toner powder images have been transferred to sheet 36, gripper fingers 54 space sheet 36 from transfer roll 38. As transfer roll 38 continues to rotate, stripper bar 56 is interposed between sheet 36 and transfer roll 38. This separates sheet 36 from transfer roll 38 and moves it onto conveyor 58. Endless belt conveyor 58 moves support material 36 to fixing station E.

At fixing station E, a fuser, indicated generally by the reference numeral 60, supplies sufficient heat to the toner powder image deposited on support material 36 to permanently affix it thereto. One type of suitable fusing apparatus is described in U.S. Pat. No. 3,907,492 issued to Draugelis et al. in 1975. After the fusing process, sheet 36 is advanced by endless belt conveyors 62 and 64 to catch tray 66 for subsequent removal therefrom by the machine operator.

Invariably, after the transfer process, residual toner particles adhere to photoconductive surface 12. These toner particles are removed therefrom as photoconductive surface 12 passes through cleaning station F. Cleaning station F, the final processing station in the direction of rotation of drum 10, includes a pre-clean corona generating device (not shown) for neutralizing the charge on photoconductive surface 12 and that of the residual toner particles. This enables fibrous brush 68, in contact with photoconductive surface 12, to remove the residual toner particles thereon. A suitable brush cleaning system is described in U.S. Pat. No. 3,590,412 issued to Gerbasi in 1971.

It is believed that the foregoing description is sufficient for purposes of the present application to describe the general features of an electrophotographic printing machine having the features of the present invention incorporated therein.

Figure 2:
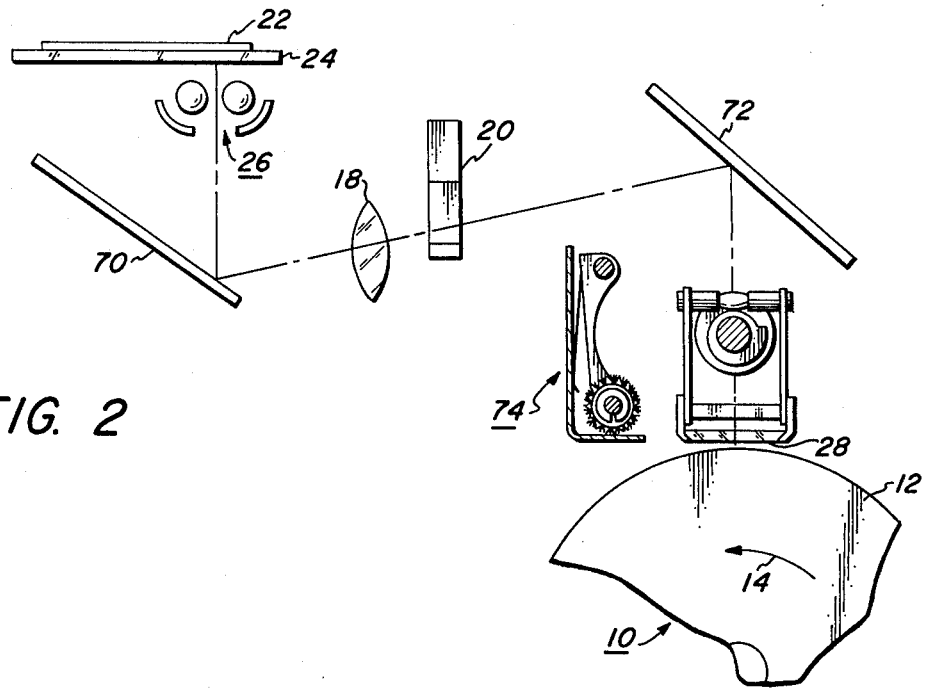
FIG. 2 is an elevational view of one embodiment of the exposure system employed in the FIG. 1 electrophotographic printing machine.

Referring now to FIG. 2, there is shown one embodiment of exposure station B. As shown thereat, lamps 26 move across platen 24 with original document 22 being disposed facedown thereon. The light rays reflected from original document 22 pass through transparent platen 24 onto mirror 70. Mirror 70 reflects the light rays through lens 18 to form a flowing light image thereof. The flowing light image is then transmitted through the appropriate filter of filter mechanism 20 to produce a single color flowing light image. This single color flowing image is reflected by mirror 72 through screen member 28 forming a modulated single color flowing light image. Screen member 28 is mounted in housing 74. Housing 74 includes the cleaning apparatus associated with screen member 28. Thus, as screen member 28 pivots from the operative position (shown in FIG. 2) to the inoperative position remote from photoconductive surface 12, the cleaning device removes particles therefrom. The detailed structure of housing 74 will be described hereinafter in greater detail with reference to FIGS. 4 through 6, inclusive. As the single color light image passes through screen member 28, it is modulated. Hence, the modulated single color light image irradiates the charged portion of photoconductive surface 12 selectively dissipating the charge thereon to record a modulated single color electrostatic latent image. The foregoing briefly describes the manner of operation when the printing machine is in the pictorial mode. In this mode of operation, contrast may be adjusted by moving screen member 28 to regulate the spacing between photoconductive surface 12 and screen member 28. In the composition or functional mode of operation, screen member 28 is moved out of the optical light path so that the light image is not modulated. Alternatively, the spacing may be increased to an optimum distance de-focusing the screen member, thereby rendering it ineffective, i.e. increasing the spacing between the screen member and photoconductive member a sufficient distance. Thus, an unmodulated single color light image irradiates the charged photoconductive surface producing a single color electrostatic latent image. Successive single color electrostatic latent images are recorded on photoconductive surface 12 and developed in the manner heretofore described. The resultant powder images are transferred to support material 36 secured to transfer roll 38. These toner powder images are then permanently affixed to the sheet of support material creating a functional copy rather than a pictorial copy of the original document.

It is apparent that the prime distinction between the functional copying mode and the pictorial copying mode resides in the usage or non-usage of the screen. In the pictorial copying mode, the screen member modulates the light image producing a pictorial copy. Contrawise, in the functional copying mode, the screen member is ineffective and the light image remains unmodulated resulting in a functional copy. Finally, a third mode of operation is the composition mode. In this mode of operation, the screen member remains ineffective. However, a screen is positioned on platen 24 masking selected portions of the original document. Thus, the platen screen only covers those portions of the original document that are pictorial, whereas the functional portions of the original document remain un-screened.

Mode selection is an operator function. The operator, by pressing a button marked functional, composition, or pictorial, selects the desired operative mode. In addition to these controls, a contrast control is contained within the printing machine. The contrast control operates in the pictorial mode to permit the machine operator to regulate the spacing between screen 28 and photoconductive surface 12. This, in turn, adjusts the contrast of the pictorial copy being reproduced.

Figure 3:
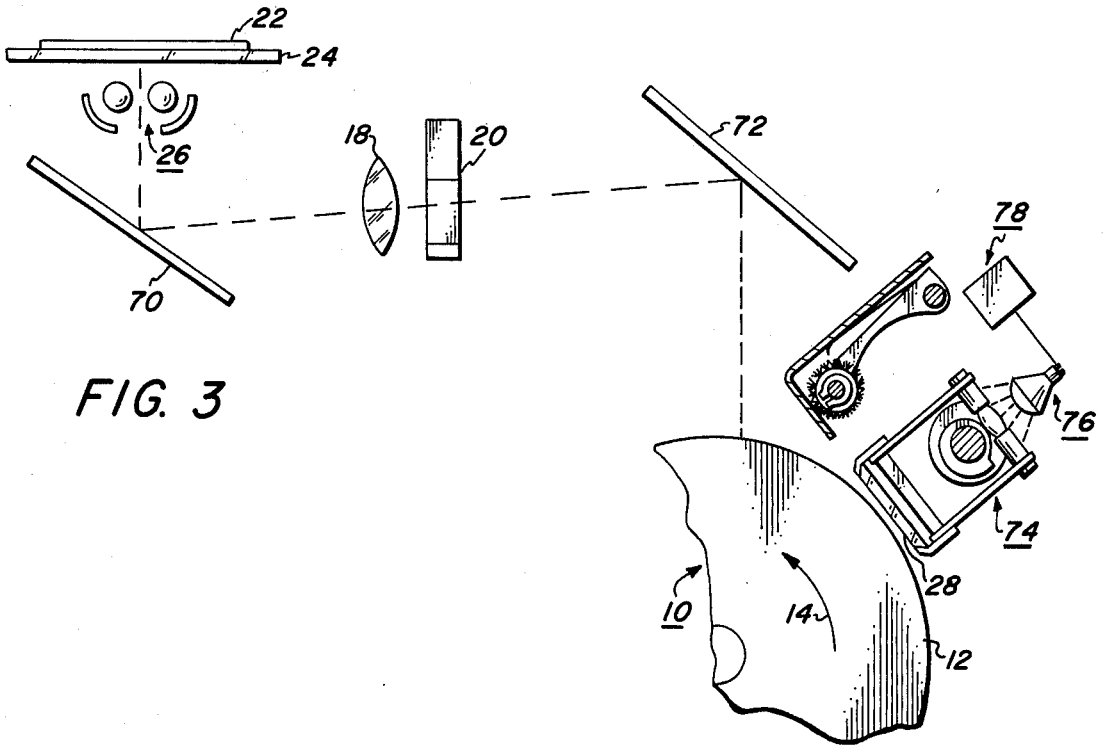
FIG. 3 is an elevational view of another embodiment of the exposure system employed in the FIG. 1 printing machine.

Referring now to FIG. 3, there is shown another embodiment of exposure station B. For illustrative purposes, screen member 28 is positioned prior to the optical light path. However, it should be noted that in this mode of operation, the screen member may be located either prior to or subsequent to the light image path as shown by arrow 14 indicating the direction of rotation of drum 10. Once again, lamps 26 move across platen 24 scanning original document 22. The light rays reflected from original document 22, are, in turn, reflected by mirror 70 through lens 18 forming a flowing light image. This flowing light image passes through the corresponding filter of filter mechanism 20 forming a single color flowing light image. The single color flowing light image is reflected in a downwardly direction by mirror 72 onto photoconductive surface 12. The flowing light image irradiates the portion of photoconductive surface 12 having the screen pattern recorded thereon. In the event the screen is located after the formation of the flowing light image, the screen light pattern is projected in superimposed registration with the latent image of the original document recorded on photoconductive surface 12. The screen pattern is formed by irradiating screen member 28 with light rays from a light source or lamp 76. The screened light rays irradiate the charged portion of photoconductive surface 12 prior to or subsequent to the formation of the original document latent image on photoconductive surface 12. Light source 76 projects light rays through screen member 28 forming a screen pattern on photoconductive surface 12. This screen pattern moves in the direction of arrow 14 and the flowing light image of the original document is projected thereon in superimposed registration therewith. Thus, the resultant composite electrostatic latent image formed on photoconductive surface 12 is modulated. This is an additive type of optical exposure system rather than multiplicative, as shown in FIG. 2. In the pictorial mode of operation, screen member 28 and light source 76 are operational. Light source 76 is excited by a voltage source 78. In order to place the copying machine in the functional mode of copying, voltage source 78 is de-energized and light source 76 is de-activated. In this manner, the light rays are not projected through screen member 28 and a screen pattern is not formed on photoconductive surface 12. Thus, the single color light image irradiating the charged portion of photoconductive surface 12 records an un-modulated latent image thereon. In addition, when the printing machine is in the functional copying mode, screen member 28 pivots from a position closely adjacent to photoconductive surface 12 to a position remote therefrom. As screen member 28 moves to the inoperative position, the cleaning device moves in a direction opposed thereto so as to remove particles thereon.

Figure 4:
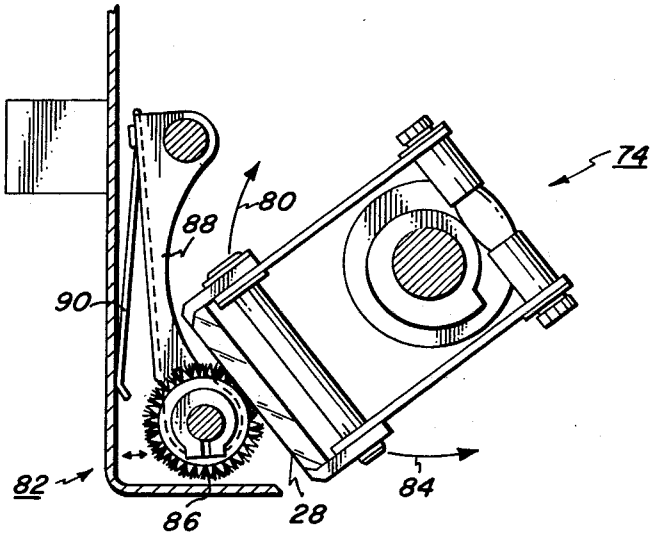
FIG. 4 is a schematic elevational view of the mechanism for cleaning the screen member employed in the FIG. 1 printing machine.

Referring now to FIG. 4, the detailed structure of housing member 72 will be described. Screen member 28 is mounted in an open-ended slot of housing 74. Housing 74 is mounted by a suitable pin and bolt arrangement pivotably to the printing machine frame. Actuation of a motor rotates housing 74 in the direction of arrow 80. As housing 74 pivots in the direction of arrow 80, screen member 28 moves from the operative position to the inoperative position. Substantially simultaneously therewith, cleaning device 82 pivots in the direction of arrow 84. Cleaning device 82 includes a brush 86 mounted rotatably at one end of arm 88. Arm 88 has the other end thereof secured pivotably to the machine frame. As housing 74 pivots in the direction of arrow 80 arm 88 pivots in the direction of arrow 84. Thus, cleaning device 82 moves in a direction opposed from that of screen member 28. In this way, brush 86 contacts screen member 28 as screen member 28 moves from the operative position to the inoperative position. A suitable motor rotates brush 86 during the cleaning process so that the fibers thereon remove particles adhering to screen member 28. Leaf spring 90 engages arm 88 to resiliently urge brush 86 into contact with screen 28.

Figure 5:
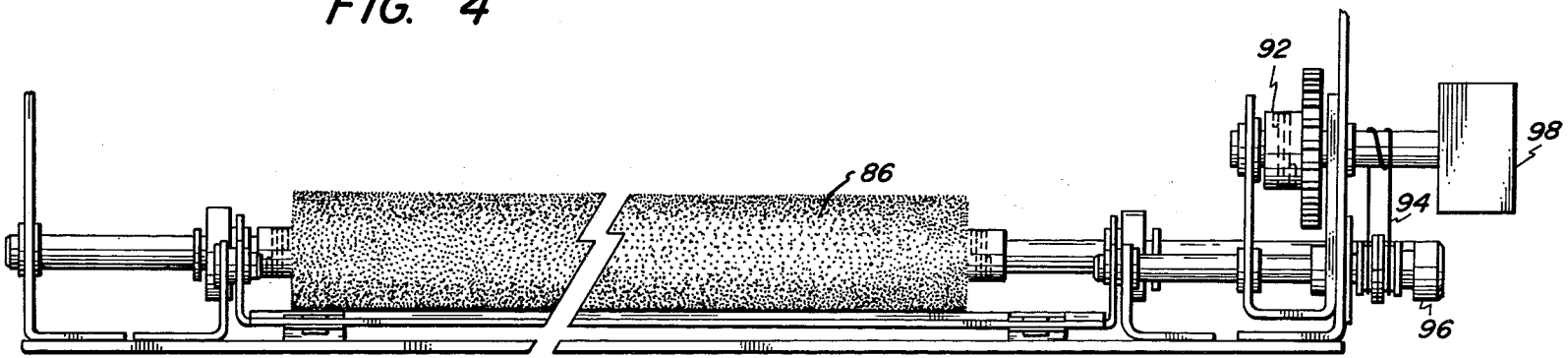
FIG. 5 is a fragmentary plan view depicting the FIG. 4 cleaning mechanism.

Referring now to FIG. 5, there is shown a plan view of the drive system for brush 86. As shown in FIG. 5, motor 98 rotates gear 92. Gear 92 is coupled to pin 96 by endless belt 94. Thus, rotation of gear 92 rotates belt 94 and, in turn, pin 96. Rotation of pin 96 pivots arm 88 as well as rotating brush 86. This may be readily seen by referring to FIG. 6.

Figure 6:
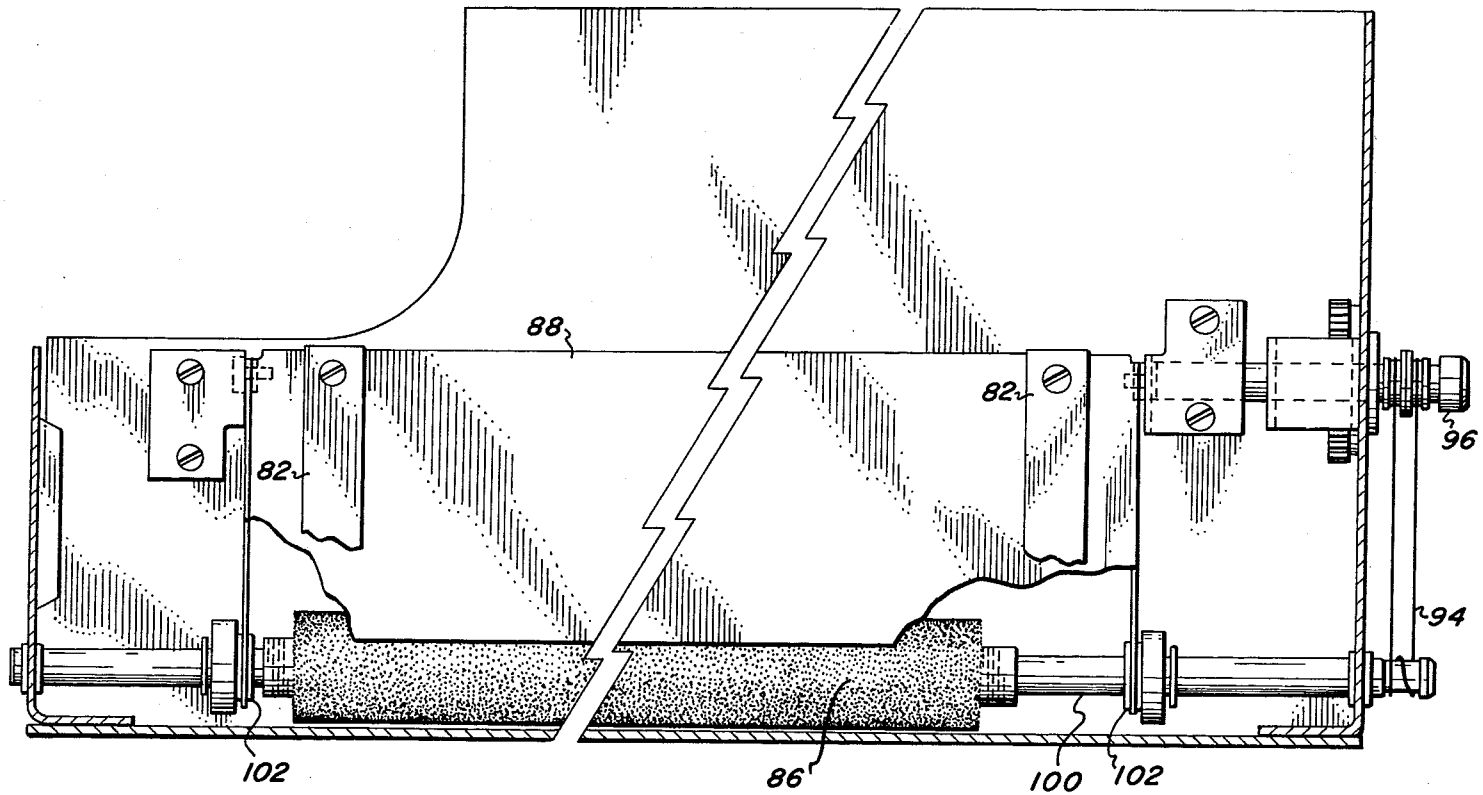
FIG. 6 is a fragmentary elevational view of the FIG. 4 cleaning mechanism.

As shown in FIG. 6, brush 86 is mounted on shaft 100. Shaft 100 is supported on arm 88 by a pair of opposed, spaced bearings 102. As pin 96 rotates, arm 88 pivots substantially simultaneously with the rotation of screen member 28. Endless belt 94 drives brush 86. Leaf spring 82 presses brush 86 into resilient engagement with screen 28. In this way, brush 86 is pivoted from an inoperative position spaced from screen member 28 to an operative position in engagement therewith. Substantially simultaneously therewith, brush 86 rotates and the fibers thereof are resiliently urged into engagement with screen member 28 by spring 82.

In recapitulation, it is evident that the apparatus of the present invention cleans the screening member as it moves from the operative position closely adjacent to the photoconductive surface to the inoperative position remote therefrom. The cleaning device moves in a direction opposed from that of the screen member and substantially simultaneously therewith. Cleaning is achieved by a rotating brush contacting the screen member. The brush rotates and pivots from the inoperative position to the operative position as the screen member pivots from the operative position to the inoperative position.

It is, therefore, apparent that there has been provided in accordance with the present invention a screen cleaning device that fully satisfies the objects, aims and advantages hereinbefore set forth. While the present invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrophotographic printing machine of the type having a photoconductive member, including:
   a movable screen member located closely adjacent to the photoconductive member in the operative position and being remote therefrom in the inoperative position; and
   means for cleaning particles from said screen member, said cleaning means being mounted for movement in unison with said screen member in a common plane and in a direction opposed thereto for removing particles therefrom during the relative movement therebetween.

2. An electrophotographic printing machine of the type having a photoconductive member, including:
   a movable screen member located closely adjacent to the photoconductive member in the operative position and being remote therefrom in the inoperative position;
   means for cleaning particles from said screen member, said cleaning means being mounted for movement in unison with said screen member in a direction opposed thereto for removing particles therefrom during the relative movement therebetween;
   means for moving said screen member from the inoperative position to the operative position and for returning said screen member to the inoperative position; and
   means for moving said cleaning means in a direction opposed from the direction of movement of said screen member substantially simultaneously therewith.

3. A printing machine as recited in claim 2, further including:
   means for charging at least a portion of the photoconductive member; and
   means for projecting a light image of an original document through said screen member onto the charged portion of the photoconductive member to discharge selectively the charge recording thereon a modulated electrostatic latent image.

4. A printing machine as recited in claim 3, wherein said projecting means includes means for filtering successive light images with differently colored filters to record successive modulated single color electrostatic latent images on the photoconductive member.

5. A printing machine as recited in claim 4, further including:

means for developing a single color electrostatic latent image with particles complementary in color to the color of the corresponding single color light image;

means for transferring successive differently colored particles from the respective latent image to a sheet of support material in superimposed registration with one another; and means for affixing the particles to the sheet of support material forming a colored copy of the original document.

6. A printing machine as recited in claim 5, wherein said cleaning means includes a brush positioned to contact said screen member during the relative movement therebetween.

7. A printing machine as recited in claim 6, wherein said cleaning means includes means for rotating said brush during the movement thereof.

8. A printing machine as recited in claim 7, wherein said cleaning means includes means for resiliently urging said brush into contact with said screen member.

9. A printing machine as recited in claim 8, wherein said screen member includes a transparent member having a plurality of substantially equally spaced opaque lines thereon.

10. A printing machine as recited in claim 8, wherein said screen member includes a transparent member having a plurality of substantially equally spaced opaque dots thereon.

11. A printing machine as recited in claim 2, further including:

means for charging at least a portion of the photoconductive member;

a light source for illuminating said screen member to irradiate the charged portion of the photoconductive member recording thereon a screen pattern; and means for projecting a light image of an original document onto the charged portion of the photoconductive member recording thereon an electrostatic latent image such that the screen pattern and electrostatic latent image are in superimposed registration with one another.

12. A printing machine as recited in claim 11, wherein said projecting means includes means for filtering successive light images with differently colored filters to record successive modulated single color electrostatic latent images on the photoconductive member.

13. A printing machine as recited in claim 12, further including:

means for developing each single color electrostatic latent image with particles complementary in color to the color of the corresponding single color light image;

means for transferring successive differently colored particles from the respective latent image to a sheet of support material in superimposed registration with one another; and means for affixing the particles to the sheet of support material forming a colored copy of the original document.

14. A printing machine as recited in claim 13, wherein said cleaning means includes a brush positioned to contact said screen member during the relative movement therebetween.

15. A printing machine as recited in claim 14, wherein said cleaning means includes means for resiliently urging said brush into contact with said screen member.

16. A printing machine as recited in claim 15, wherein said cleaning means includes means for rotating said brush during the movement thereof.

17. A printing machine as recited in claim 16, wherein said screen member includes a transparent member having a plurality of substantially equally spaced opaque lines thereon.

18. A printing machine as recited in claim 16, wherein said screen member includes a transparent member having a plurality of substantially equally spaced opaque dots thereon.

* * * * *